US009259944B2

(12) United States Patent
Moriya et al.

(10) Patent No.: US 9,259,944 B2
(45) Date of Patent: Feb. 16, 2016

(54) RECORDING APPARATUS AND RECORDING METHOD

(71) Applicant: SEIKO EPSON CORPORATION, Tokyo (JP)

(72) Inventors: Yuki Moriya, Shiojiri (JP); Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 78 days.

(21) Appl. No.: 13/788,102

(22) Filed: Mar. 7, 2013

(65) Prior Publication Data

US 2013/0314483 A1 Nov. 28, 2013

(30) Foreign Application Priority Data

May 23, 2012 (JP) ..... 2012-117786

(51) Int. Cl.

| | |
|---|---|
| ***B41J 2/01*** | (2006.01) |
| ***B41J 25/308*** | (2006.01) |
| ***B41J 11/00*** | (2006.01) |
| ***B41J 3/407*** | (2006.01) |
| ***B41J 11/06*** | (2006.01) |
| ***B41J 11/20*** | (2006.01) |
| *B41F 1/28* | (2006.01) |

(52) U.S. Cl.

CPC ..... *B41J 11/008* (2013.01); *B41J 3/4078* (2013.01); *B41J 11/06* (2013.01); *B41J 11/20* (2013.01)

(58) Field of Classification Search

CPC ..... B41J 11/20; B41J 25/308; B41J 25/312
USPC ..... 347/8
See application file for complete search history.

(56) References Cited

U.S. PATENT DOCUMENTS

| | | | | |
|---|---|---|---|---|
| 6,629,787 | B2 * | 10/2003 | Lee et al. | 400/59 |
| 7,413,301 | B2 * | 8/2008 | Niimi et al. | 347/104 |
| 7,559,616 | B2 | 7/2009 | Kuki et al. | |
| 8,079,697 | B2 * | 12/2011 | Niekawa | 347/102 |
| 2006/0192798 | A1 | 8/2006 | Kuki et al. | |
| 2008/0278525 | A1 * | 11/2008 | Lin et al. | 347/8 |

FOREIGN PATENT DOCUMENTS

| | | |
|---|---|---|
| JP | 2006-239866 | 9/2006 |
| JP | 2006-240107 | 9/2006 |

* cited by examiner

*Primary Examiner* — Shelby Fidler
*Assistant Examiner* — Tracey McMillion
(74) *Attorney, Agent, or Firm* — Workman Nydegger

(57) ABSTRACT

A recording apparatus includes a recording unit that performs recording, a tray on which a target recording medium is set, a movement mechanism that moves the tray relative to the recording unit between a setting operation position at which the target recording medium is set on the tray and a recording start position at which recording starts, an adjustment section that is configured to adjust a distance between the recording unit and the tray, and a mark that corresponds to a position of the recording unit in a direction in which the distance is adjusted.

8 Claims, 10 Drawing Sheets

RECORDING APPARATUS AND RECORDING METHOD

BACKGROUND

1. Technical Field

The present invention relates to a recording apparatus that performs recording on a target recording medium and a recording method.

2. Related Art

Recording apparatuses are used which are capable of performing recording on a target recording medium of different thickness. In such recording apparatuses, it is necessary to adjust a height of a tray on which the target recording medium is set or a height of a recording surface of a recording unit (for example, an ink ejection surface of a recording head) depending on the type of the target recording medium. Without this adjustment, a distance between the recording surface of the recording unit and a target recording surface of the target recording medium (hereinafter, referred to as "PG") may not become an appropriate distance, which leads to failure in achieving a desired recording image. Moreover, the recording surface of the recording unit and the target recording surface of the target recording medium may come into contact with each other, which causes damage on the recording unit and the target recording medium.

For example, JP-A-2006-239866 discloses a technique to adjust PG to a predetermined distance. JP-A-2006-239866 discloses a recording apparatus that has a contact which comes into contact with a target recording surface of a fabric at a position on the leading side in the recording direction of a recording head so as to adjust the height of the recording head based on the height of the contact.

Further, recording apparatuses that perform recording on a target recording medium of different thickness also include those in which a height of a tray on which the target recording medium is set is visually adjusted based on a height of an ink ejection surface of the recording head in order to achieve a predetermined distance for PG during setting of the target recording medium on the tray.

Moreover, recording apparatuses that perform recording on a target recording medium of different thickness also include those in which a position at which the target recording medium is set on the tray (hereinafter, referred to as "setting operation position") is provided spaced away from the recording head.

JP-A-2006-239866 describes that the recording apparatus is configured to adjust the height of the recording head based on the height of the target recording surface of the target recording medium via the contact, and does not describe that the height of the tray is visually adjusted based on the height of the ink ejection surface. That is, it is not intended in JP-A-2006-239866 to visually adjust the height of the tray based on the height of the ink ejection surface during setting of the target recording medium on the tray.

Further, in the recording apparatus in which the setting operation position is provided spaced away from the recording head, it is difficult to visually adjust the height of the tray during setting of the target recording medium on the tray. It is because highly precise adjustment of the height of the tray based on the height of the ink ejection surface of the recording head is difficult since the tray is spaced away from the recording head.

SUMMARY

An advantage of some aspects of the invention is that a recording apparatus that is capable of highly precise visual adjustment of the position of the tray is provided by achieving a predetermined PG even if the position at which the target recording medium is set on the tray is spaced away from the recording unit.

According to a first embodiment of the invention, a recording apparatus includes a recording unit that performs recording, a tray on which a target recording medium is set, a movement mechanism that moves the tray relative to the recording unit between a setting operation position at which the target recording medium is set on the tray and a recording start position at which recording starts, an adjustment section that is configured to adjust a distance between the recording unit and the tray, and a mark that corresponds to a position of the recording unit in a direction in which the distance is adjusted.

The term "move the tray relative to" as used herein refers to not only a configuration to move the tray relative to the recording unit, but also to move the recording unit relative to the tray, and also to move both the tray and the recording unit. Further, the term "recording unit" as used herein refers to a unit that is capable of performing recording. The "recording unit" is not limited to a recording head of an ink jet recording apparatus used in the embodiments which will be described later, and may include, for example, a transferring unit of a transfer type recording apparatus.

According to the first embodiment, the mark that corresponds to the position of the recording surface can be used as a reference instead of the recording surface (for example, ink ejection surface) of the recording unit for adjustment of the distance between the recording surface of the recording unit and the set surface of the tray. Accordingly, even in the recording apparatus in which the position at which the target recording medium is set on the tray (setting operation position) is provided spaced away from the recording unit for ease of operation, it is possible to adjust the distance between the recording surface of the recording unit and the set surface of the tray with high precision.

According to a second embodiment of the invention, a recording apparatus includes a recording unit having a recording surface that performs recording, a tray having a set surface on which a target recording medium is set, a movement mechanism that moves the tray relative to the recording unit in a first direction for performing recording, and an adjustment section that is configured to adjust a distance between the recording surface and the set surface, wherein the setting operation position at which the target recording medium is set on the tray is a position shifted from the recording unit in the first direction, and a mark that corresponds to a position of the recording surface in the direction in which the distance is adjusted is provided.

According to the second embodiment, the mark that corresponds to the position of the recording surface can be used as a reference instead of the recording surface of the recording unit for adjustment of the distance between the recording surface of the recording unit and the set surface of the tray. Accordingly, even in the recording apparatus in which the position at which the target recording medium is set on the tray is provided spaced away from the recording unit for ease of operation, it is possible to adjust the distance between the recording surface of the recording unit and the set surface of the tray with high precision.

According to a third embodiment of the invention, in the recording apparatus of the first or second embodiment, the mark is disposed between the tray which is located at the setting operation position and the recording unit.

According to the third embodiment, since the mark is disposed closer to the tray than the recording unit is, it is easy to adjust the distance between the recording surface and the set surface.

According to a fourth embodiment of the invention, in the recording apparatus of the third embodiment, the mark is provided on a plate member that extends in the direction in which the distance is adjusted and has a width greater than that of the tray.

When a fabric such as T-shirt which is used as the target recording medium is set on the tray, a portion of the fabric which extends out of the set surface may be caught in other components around the tray depending on the amount of the portion which extends out of the set surface.

According to the fourth embodiment, since the plate member is disposed between the recording unit and the tray and has the width greater than that of the tray, it is possible to prevent the portion of the fabric which extends out of the set surface from being caught in other components. Accordingly, the plate member also serves to prevent the portion of the fabric which extends out of the set surface from "being caught in" other components, and also provides a position of the mark for adjustment of the distance between the recording surface of the recording unit and the set surface of the tray.

According to a fifth embodiment of the invention, in the recording apparatus of the fourth embodiment, a top side of the plate member in the direction in which the distance is adjusted also serves as the mark.

According to the fifth embodiment, since the top side of the plate member also serves as the mark, the mark can be provided by fabricating the plate member which also serves as the mark and providing the plate member between the recording unit and the tray. Accordingly, an additional process to provide the mark can be eliminated, thereby improving work efficiency in assembling the recording apparatus.

Further, since the plate member has the width greater than that of the tray, the top side of the plate member, that is, the mark also has a width greater than that of the tray. Accordingly, the mark extends along the entire tray in the width direction, it is possible to adjust the entire tray in the width direction with high precision during adjustment of the distance between the recording surface of the recording unit and the set surface of the tray.

According to a sixth embodiment of the invention, in the recording apparatus of the first or second embodiment, the mark is provided on an exterior of the recording apparatus.

According to the sixth embodiment, the mark can be easily provided without need of additional member. Further, the mark with good visibility can be provided since the mark is provided on the exterior of the recording apparatus.

According to a seventh embodiment of the invention, the recording apparatus of the first or second embodiment includes a movable arm, wherein the mark is disposed on the arm.

The term "movable" as used herein refers to an ability to move, including rotating, pivoting, and sliding, and does not limit the way how it moves.

According to the seventh embodiment, the arm having the mark can be advanced only during adjustment of the distance between recording surface and the set surface, and can be retracted to be stored in the rest of the time.

According to an eighth embodiment of the invention, a recording method of a recording apparatus that includes a recording unit having a recording surface that performs recording, and a tray having a set surface on which a target recording medium is set, the setting operation position at which the target recording medium is set on the tray being spaced away from the recording area of the recording unit in the first direction, includes adjusting a distance between the recording surface and the set surface according to the mark disposed on the recording apparatus at the setting operation position.

According to the eighth embodiment, even in the recording apparatus in which the position at which the target recording medium is set on the tray is provided spaced away from the recording unit, it is possible to visually adjust the height of the tray to a predetermined PG with high precision.

According to a ninth embodiment of the invention, a recording method of a recording apparatus that includes a recording unit having a recording surface that performs recording, and a tray having a set surface on which a target recording medium is set, the setting operation position at which the target recording medium is set on the tray being a position shifted from the recording unit in the first direction, includes adjusting a distance between the recording surface and the set surface according to the mark disposed on the recording apparatus at the setting operation position.

According to the ninth embodiment, even in the recording apparatus in which the position at which the target recording medium is set on the tray is provided so spaced from the recording unit that the tray needs to be moved, it is possible to visually adjust the height of the tray to a predetermined PG with high precision.

BRIEF DESCRIPTION OF THE DRAWINGS

The invention will be described with reference to the accompanying drawings, wherein like numbers reference like elements.

DESCRIPTION OF EXEMPLARY EMBODIMENTS

A recording apparatus according to embodiments of the invention will be described below in detail.

In the following embodiments, an ink jet recording apparatus that performs recording by ejecting ink from a recording head will be explained as an example of a recording apparatus. However, the invention is not limited to the ink jet recording apparatus and also includes, for example, a transfer type recording apparatus.

The recording apparatus according to the invention includes a movement mechanism that moves a tray relative to a recording unit. In the following embodiments, a recording apparatus having a movement mechanism that moves a tray relative to a recording unit will be explained. However, the invention also includes a recording apparatus that performs recording by moving the recording unit without moving the tray. Further, the invention also includes a recording apparatus that is configured to move both the tray and the recording unit.

In the following embodiments, a T-shirt made from a fabric will be explained as an example of a target recording medium. However, the target recording medium that can be used in the invention is not limited to the T-shirt or the fabric. For example, the target recording medium that can be used in the invention also includes a rigid type target recording medium such as a panel board.

First Embodiment

FIGS. 1-6

Figure 1:
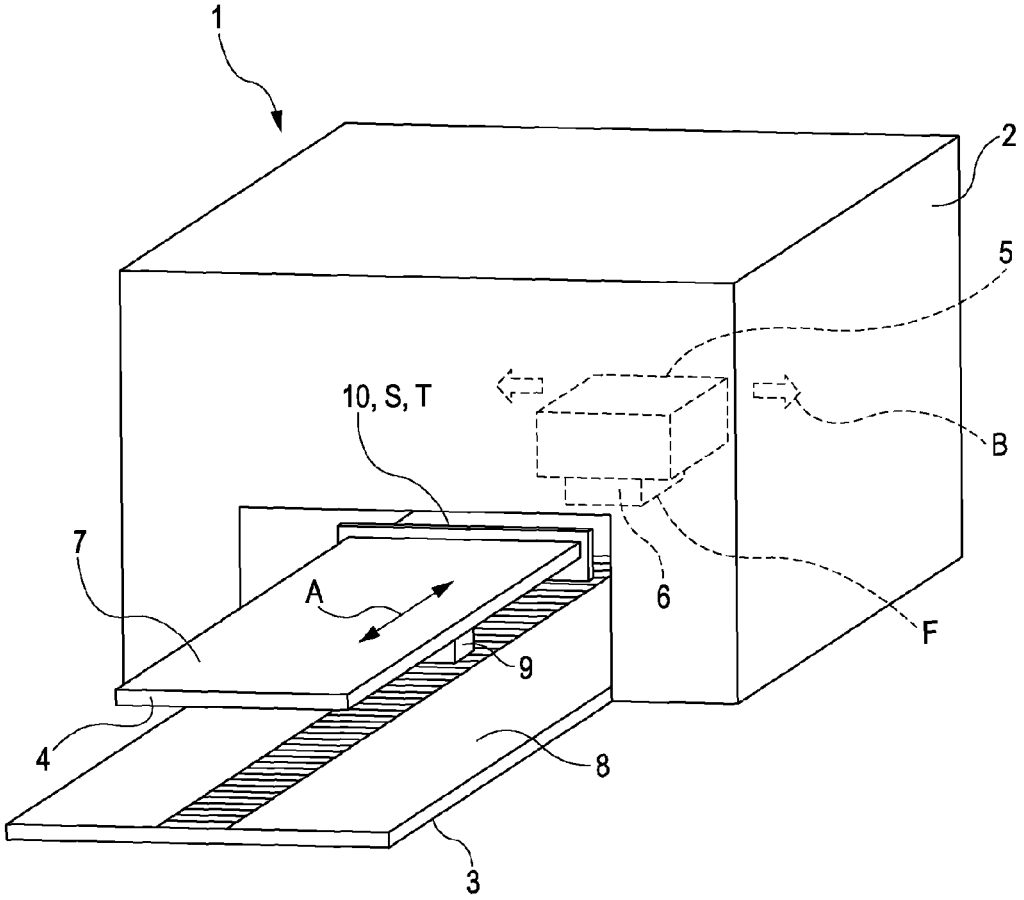
FIG. 1 is a schematic perspective view of a recording apparatus according to a first embodiment of the invention.

FIG. 1 is a schematic perspective view of a recording apparatus according to a first embodiment of the invention. As shown in FIG. 1, a recording apparatus 1 according to this embodiment includes a tray 4 having a set surface 7 on which a target recording medium P is set (see FIG. 5B). A transportation unit 3 as a movement mechanism is configured to transport the target recording medium P by moving the tray 4 in transportation direction A which is a first direction. The transportation unit 3 moves the tray 4 while keeping the height of the tray 4.

An apparatus body 2 includes a recording head 6 as a recording unit. The recording apparatus 1 forms a desired image by ejecting ink from the recording head 6 onto the target recording medium P while reciprocating the recording head 6 via a carriage 5 in a scan direction B which is perpendicular to the transportation direction A. Further, an area that faces an ink ejection surface F when the recording head 6 reciprocates in the scan direction B during recording is a recording area R (see FIG. 2).

In the recording apparatus 1 of this embodiment, a setting operation position L1 (see FIG. 3) at which the target recording medium P is set on the tray 4 is different from a recording start position L2 (see FIG. 4) at which recording starts. As will be described later, the recording apparatus 1 of this embodiment in FIG. 1 has the setting operation position L1 on the front side and the recording start position L2 on the back side. Once the target recording medium P is set at the setting operation position L1 on the front side of the recording apparatus 1 of this embodiment, the tray 4 is moved to the recording start position L2 on the back side. After that, recording is performed while moving the tray 4 from the recording start position L2 toward the front side.

That is, the setting operation position L1 is spaced apart from the recording area of the recording head 6 in the transportation direction A. In other words, the setting operation position L1 is located at a position shifted from the recording head 6 by a predetermined distance in the transportation direction A. In FIG. 1, the lower left side of the figure is the front side of the recording apparatus 1 and the upper right side of the figure is the back side of the recording apparatus 1.

The tray 4 is supported by a guide table 8 of the transportation unit 3 via a support mechanism 9. A plate member 10 having a mark S for adjusting the height of the set surface 7 of the tray 4 is attached to the support mechanism 9. An upper side, that is, a top side T of the plate member 10 also serves as the mark S for adjusting the height of the set surface 7 of the tray 4.

The height of the top side T of the plate member 10 corresponds to the height of the ink ejection surface F which is a recording surface of the recording head 6. In this embodiment, a distance between the height of the ink ejection surface F and the height of the top side T of the plate member 10 is configured to become a desired PG. In FIG. 1, the ink ejection surface F is provided on the underside of the recording head 6. Further, in this embodiment, the height of the mark S is provided at the height of the desired PG.

The mark S may be provided at any position that corresponds to the position of the recording surface of the recording unit based on other reference. For example, the mark S may be adjusted to the height of the ink ejection surface F itself. In the recording apparatus 1 in which the position of the mark S is adjusted to the height of the ink ejection surface itself, it is preferable that the recording head 6 is retractable so as not to come into contact with the plate member 10 when the plate member 10 enters the scan area of the recording head 6. Alternatively, in the recording apparatus 1 in which the position of the mark S is adjusted to the height of the ink ejection surface itself, it is preferable that the mark S is provided at a position that does not face the recording head 6.

Figure 2:
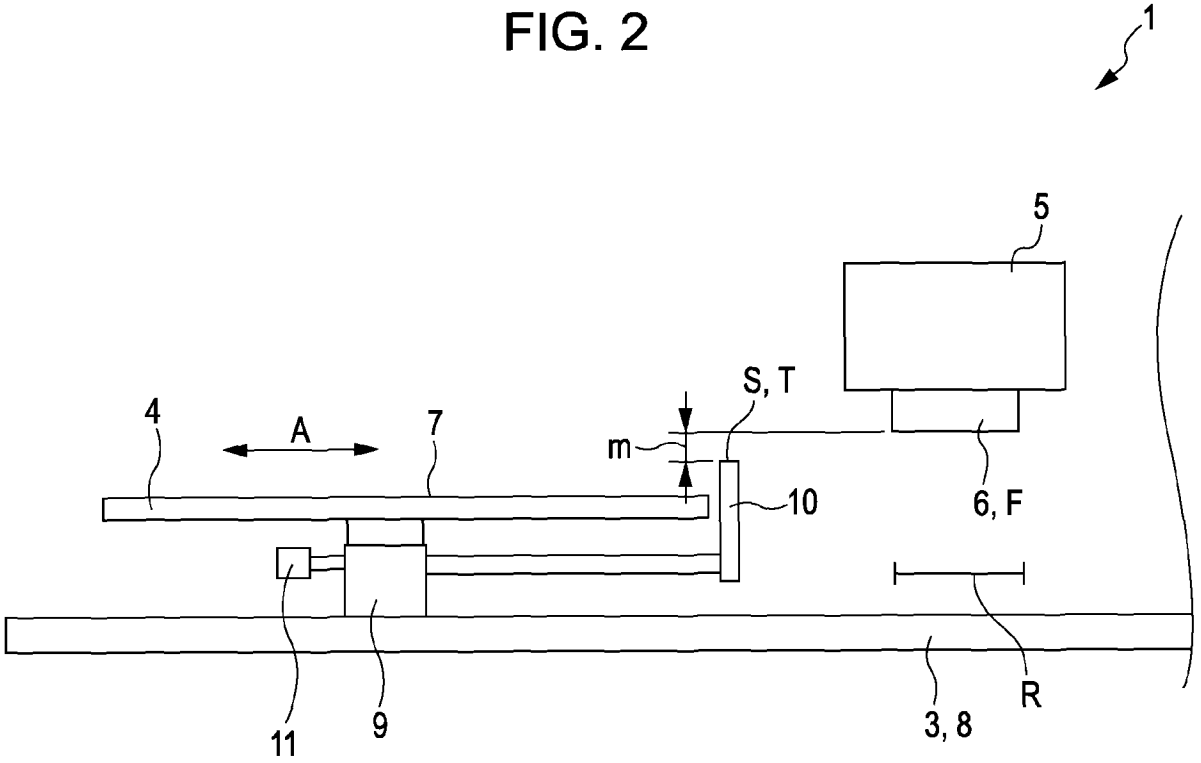
FIG. 2 is a schematic side view of the recording apparatus according to the first embodiment of the invention.

FIG. 2 is a schematic side view of the recording apparatus according to the first embodiment of the invention. The height of the set surface 7 of the tray 4 can be adjusted by a user turning a height adjustment lever 11 which is an adjustment section disposed on the support mechanism 9. Although the height adjustment lever 11 according to this embodiment can adjust the height in a non-stepwise manner, an adjustment section that can adjust the height in a stepwise manner may be used. A distance m between the height of the ink ejection surface F and the height of the top side (mark S) of the plate member 10 is configured to become a desired PG.

In this embodiment, since the plate member 10 is mounted on the base of the support mechanism 9, the height remains the same even when the height adjustment lever 11 is turned. Further, the height of the recording head 6 also remains the same. Alternatively, a configuration is also possible in which the height of the recording head is adjustable and the height of the mark S is varied in response to adjustment of the height of the recording head.

In this embodiment, the distance between the ink ejection surface F and the set surface 7 is adjusted in the height direction (vertical direction). However, the recording apparatus in which the distance between the ink ejection surface F and the set surface 7 is adjusted in a direction other than the height direction is also within the scope of the recording apparatus according to the invention.

Figure 3:
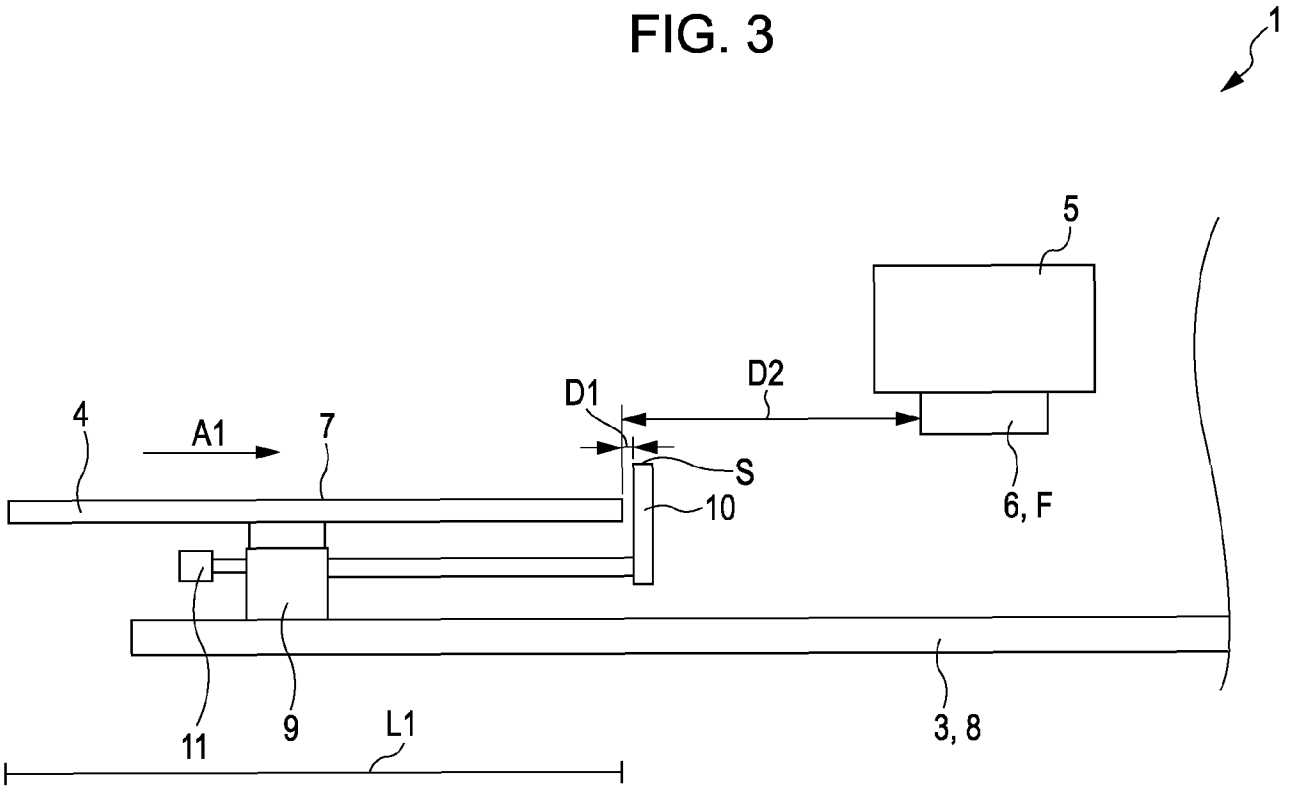
FIG. 3 is a schematic side view of the recording apparatus according to the first embodiment of the invention.

FIG. 3 is a schematic side view of the recording apparatus according to the first embodiment of the invention, which shows that the tray 4 is at the setting operation position L1.

In the recording apparatus 1 of this embodiment, the setting operation position L1 is located on the front side in FIG. 1. Once the target recording medium P is set on the tray 4 at the setting operation position L1, the transportation unit 3 moves the tray 4 in a direction A1 to the recording start position L2. A distance D1 between the tray 4 and the mark S is preferably short, since the target recording surface 12 of the target recording medium P (see FIG. 5) is easily adjusted to the mark S. It is preferable that at least the distance D1 at the setting operation position L1 is shorter than the distance D2 between the tray 4 and the recording head 6 at the setting operation position L1.

Figure 4:
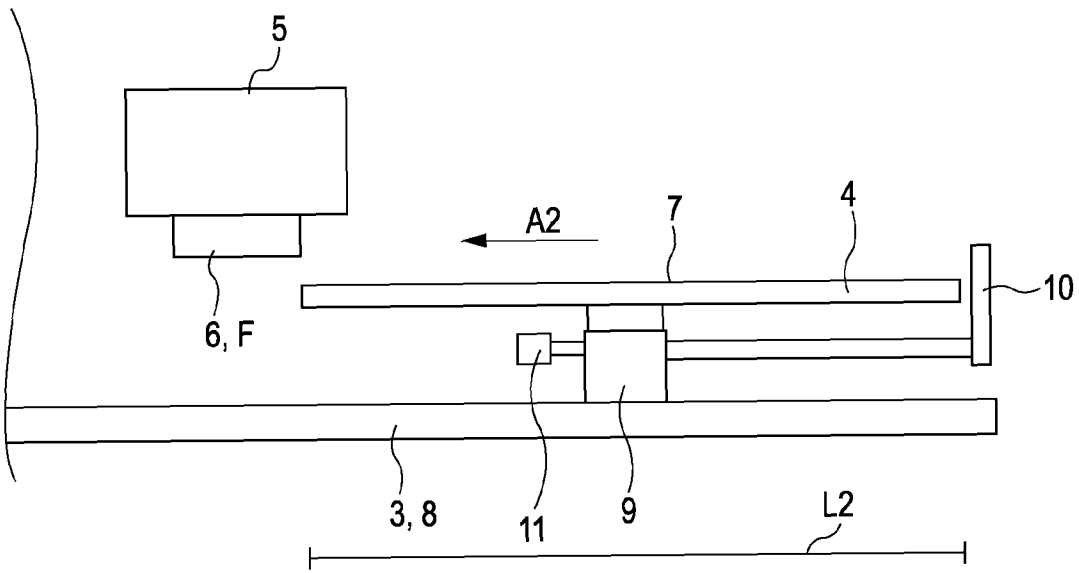
FIG. 4 is a schematic side view of the recording apparatus according to the first embodiment of the invention.

FIG. 4 is a schematic side view of the recording apparatus according to the first embodiment of the invention, which shows that the tray 4 is at the recording start position L2.

In the recording apparatus 1 of this embodiment, the position of the tray 4 at which recording starts is located on the back side in FIG. 1. When recording starts, the tray 4 is moved from the setting operation position L1 shown in FIG. 3 to the recording start position L2 shown in FIG. 4 by the transportation unit 3. After the tray 4 is moved to the recording start position L2 shown in FIG. 4, the recording apparatus 1 performs recording while moving the tray 4 in a direction A2.

Figure 5A:
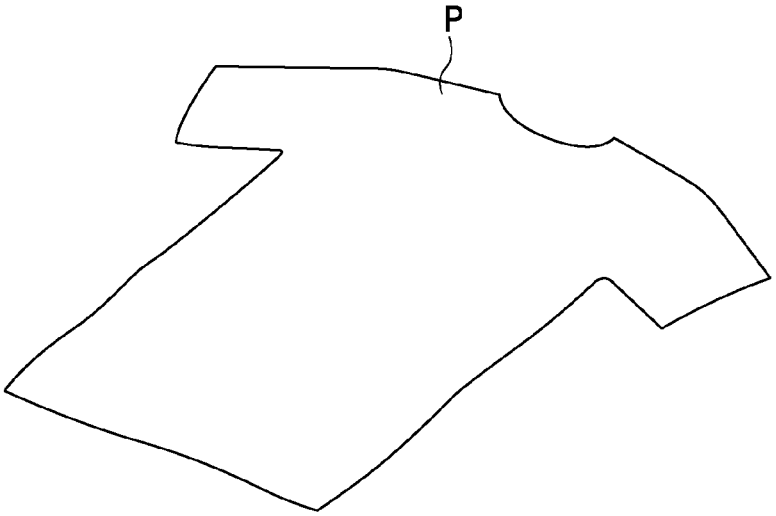
FIGS. 5A and 5B are perspective views which show an example of a target recording medium of the invention.
Figure 5B:
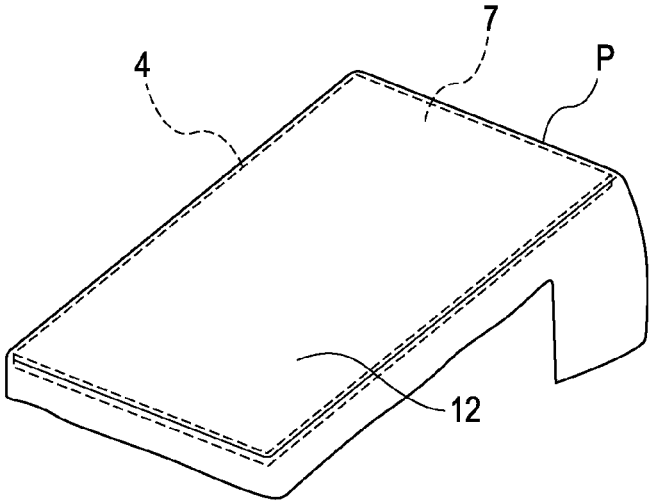

FIG. 5A is a perspective view of one example of the target recording medium of the invention. FIG. 5B is a perspective view which shows that the target recording medium is set on the tray 4.

FIG. 5A shows a T-shirt as a target recording medium P of this embodiment. As shown in FIG. 5B, the target recording medium P is set on the upper side of the set surface 7 of the tray 4. In this embodiment, adjustment is performed so that the height of the target recording surface 12 of the target recording medium P which is set on the tray 4 and the height of the top side of the plate member 10 which constitutes the mark S match each other. Specifically, adjustment is performed by the user tuning the height adjustment lever 11 based on the mark S.

Figure 6:
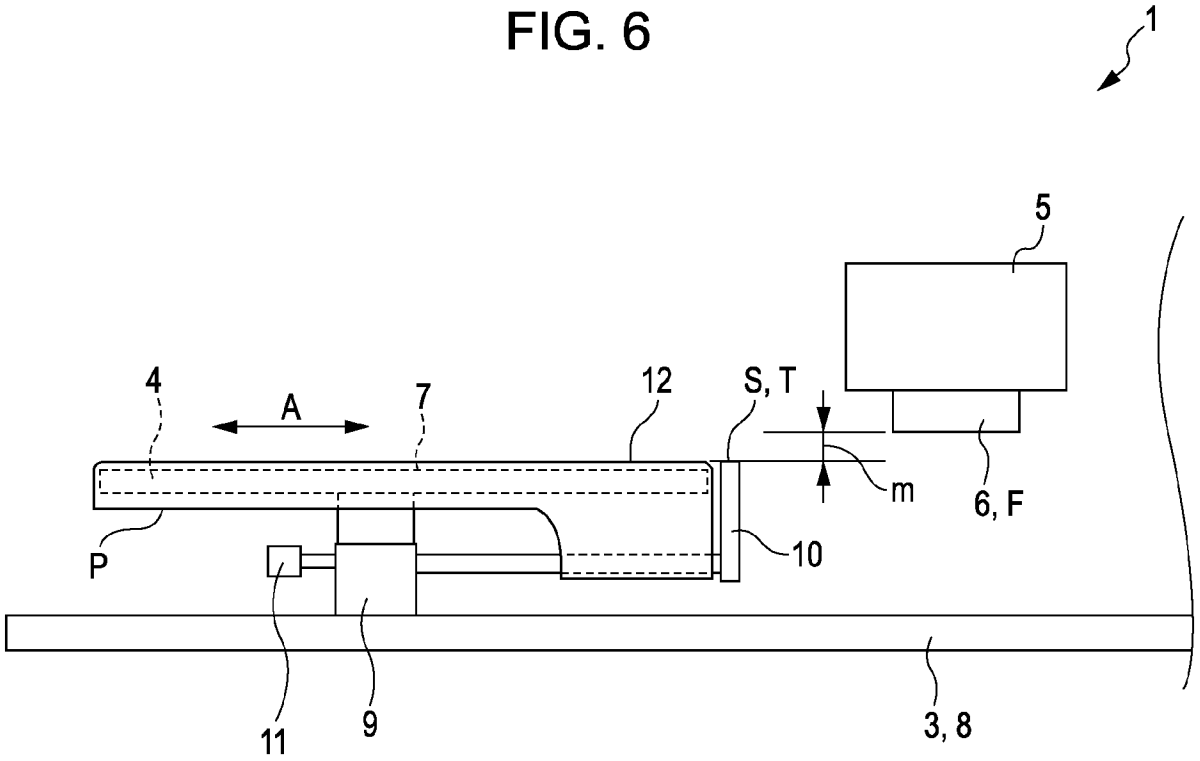
FIG. 6 is a schematic side view of the recording apparatus according to the first embodiment of the invention.

FIG. 6 is a schematic side view of the recording apparatus according to the first embodiment which shows that the height of the set surface 7 of the tray 4 is adjusted.

When the user turns the height adjustment lever 11 to adjust the height of the set surface 7 of the tray 4, the height of the target recording surface 12 of the target recording medium P is adjusted to the height of the top side of the plate member 10 as the mark S. When the height of the set surface 7 is adjusted in this manner, a distance between the target recording surface 12 and the ink ejection surface becomes equal to a distance of a desired PG.

In this embodiment, the plate member 10 having the mark S is disposed adjacent to the tray 4. Accordingly, it is easy to compare the height of the target recording surface 12 of the target recording medium P with the height of the mark S. However, the invention is not limited to such configuration. In the recording apparatus that performs recording on the target recording medium having different thickness, a set position of the target recording medium is often disposed spaced away from the position of the recording head. Even with such configuration, the height of the target recording medium P can be easily adjusted with high precision in the recording apparatus 1 of this embodiment.

Further, in this embodiment, the plate member 10 having the mark S is provided between the tray 4 in the setting operation position L1 and the recording head 6. With this configuration, it is easy to compare the height of the target recording surface 12 of the target recording medium P with the height of the mark S from the front of the recording apparatus 1. However, the invention is not limited to such configuration.

Further, the plate member 10 is provided between the tray 4 in the setting operation position L1 and the recording head 6 so as to extend in the height direction which is a direction in which the distance between the ink ejection surface F and the set surface 7 is adjusted. Moreover, the plate member 10 has a width larger than that of the tray 4, which provides an effect to prevent part of the target recording medium P from being caught in the apparatus body 2 and to shield the apparatus body 2. However, the invention is not limited to such configuration, and any shape and any material, for example, a mesh type plate member, can be used for the plate member.

In the recording apparatus 1 of this embodiment, since the top side of the plate member 10 in a direction in which the distance between the ink ejection surface F and the set surface 7 is adjusted also serves as the mark S, an additional member that provides a mark is not necessary. However, the invention is not limited to the configuration in which the top side of the plate member 10 also serves as the mark S. For example, a configuration is possible in which the plate member 10 has the top side at lower position and a member having the mark S is provided to move forward or backward or rotate from the plate member 10 so that the member also serves as a mark during adjustment and is retracted after adjustment.

Second Embodiment

FIG. 7

Figure 7:
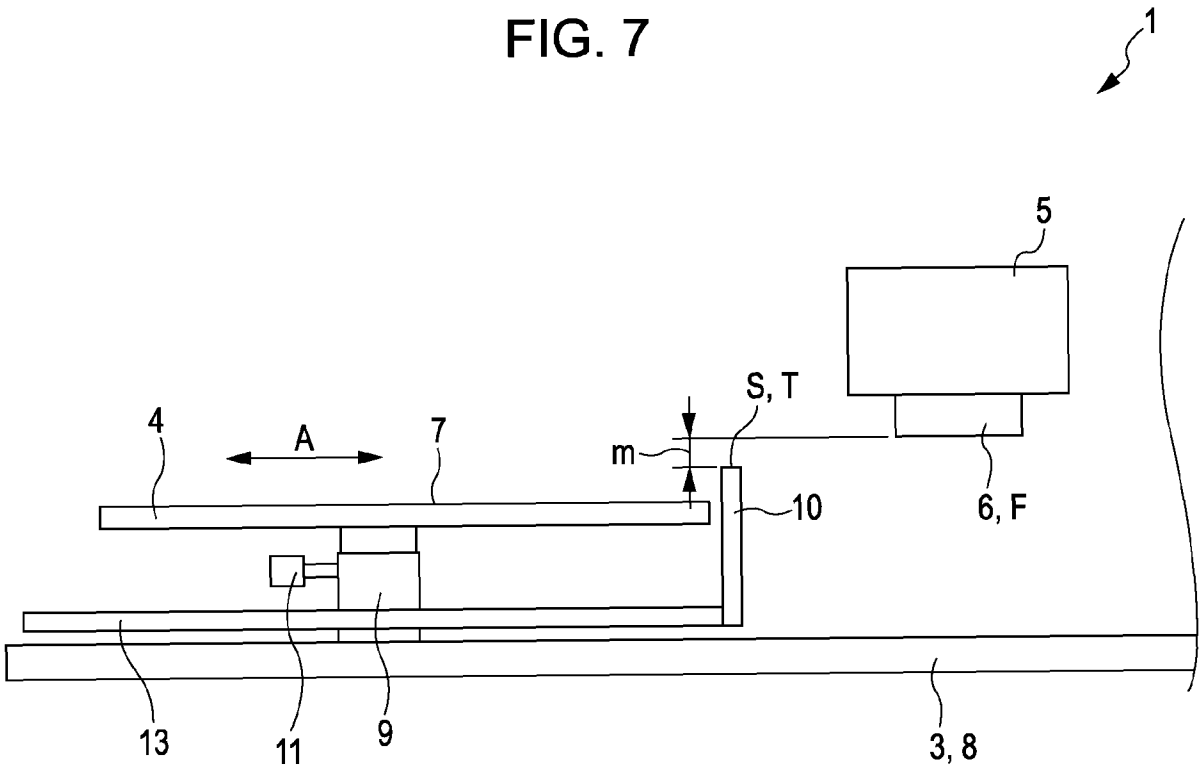
FIG. 7 is a schematic side view of a recording apparatus according to a second embodiment of the invention.

FIG. 7 is a schematic side view of a recording apparatus according to a second embodiment of the invention. The components similar to those of the first embodiment are denoted by the same reference numerals and further description thereof will be omitted.

The recording apparatus 1 of this embodiment includes a storage tray 13 under the tray 4 so as to store the portion of the target recording medium P which is not to be recorded. A bottom side of the plate member 10 is integrally connected with the storage tray 13, while a top side also serves as the mark S for adjusting the height of the set surface 7 of the tray 4. The plate member 10 is provided between the tray 4 in the setting operation position and the recording head 6 so as to extend in the height direction which is a direction in which the distance between the ink ejection surface F and the set surface 7 is adjusted. Moreover, the plate member 10 has a width larger than that of the tray 4.

Since the storage tray 13 is mounted on the base of the support mechanism 9, the storage tray 13 and the plate member 10 integrally move with the tray 4 when the tray 4 moves.

The recording apparatus 1 of this embodiment has the following effect in addition to that of the recording apparatus 1 of first embodiment. Since the recording apparatus is configured to have the storage tray 13 under the tray 4, it is easy to set the target recording medium P that has a large portion not to be recorded, thereby reducing a risk of the target recording medium P being damaged by or caught in surrounding components.

Further, in the recording apparatus 1 of this embodiment, the bottom side of the plate member 10 is connected to the storage tray 13. This provides an effect to prevent part of the target recording medium stored in the storage tray 13 from being caught in the apparatus body 2 and to shield the apparatus body 2 to the extent greater than that in the recording apparatus 1 of first embodiment.

Third Embodiment

FIG. 8

Figure 8:
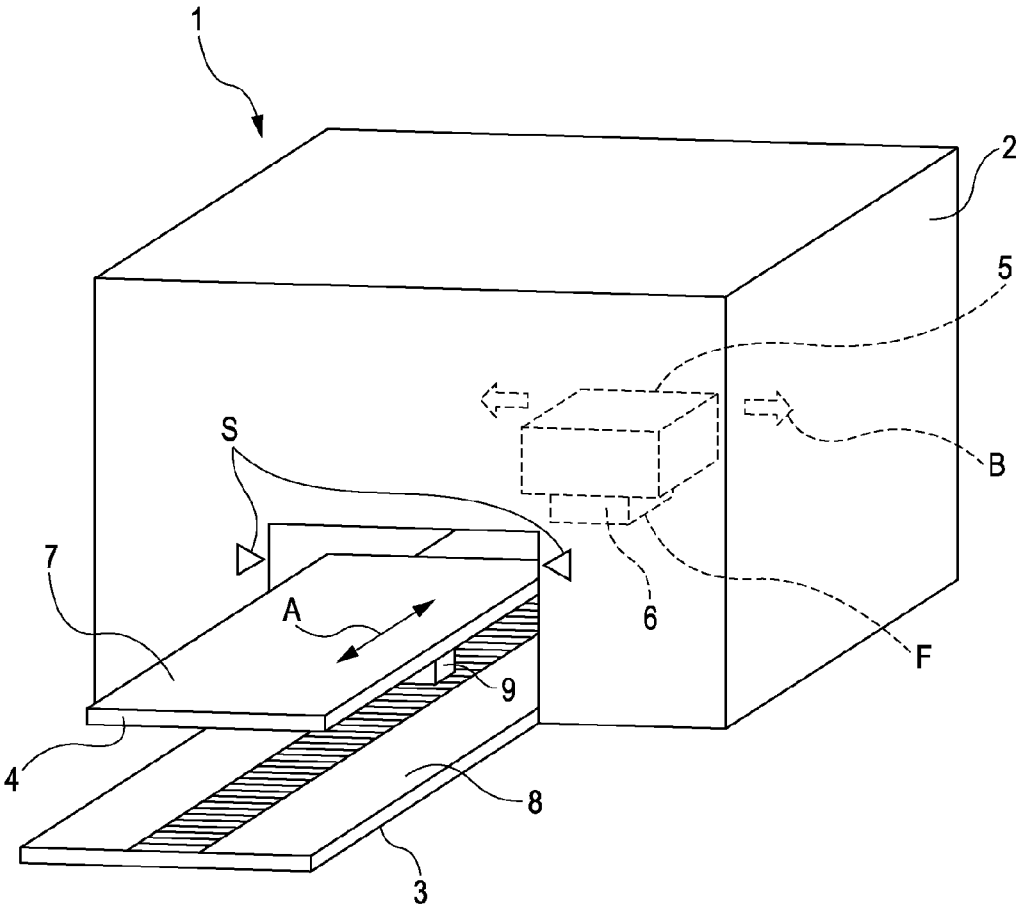
FIG. 8 is a schematic perspective view of a recording apparatus according to a third embodiment of the invention.

FIG. 8 is a schematic perspective view of a recording apparatus according to a third embodiment of the invention. The components similar to those of the first embodiment are denoted by the same reference numerals and further description thereof will be omitted.

The recording apparatus 1 of this embodiment includes triangle-shaped marks S for adjustment of the height of the target recording surface 12 of the target recording medium P which are disposed on the exterior of the recording apparatus 1. Further, the marks S are disposed on the exterior at positions adjacent to the setting operation position. In the recording apparatus that performs recording on the target recording medium having different thickness, the setting operation position is often provided spaced away from the recording head, and accordingly, the exterior often extends from a location of the recording head to a location adjacent to the setting operation position. In the recording apparatus 1 of this embodiment having such a configuration, the mark S can be easily provided without need of an additional member for the mark, thereby achieving precise height adjustment of the tray 4.

Fourth Embodiment

FIG. 9

Figure 9:
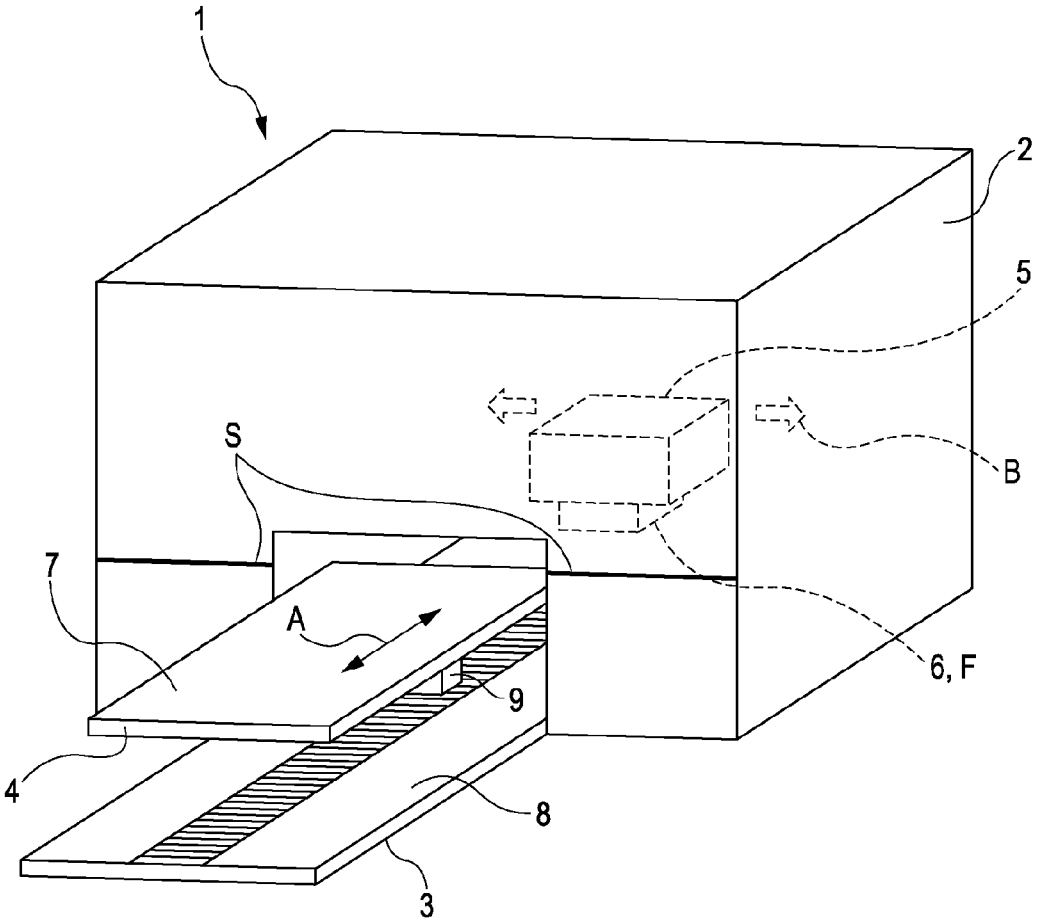
FIG. 9 is a schematic perspective view of a recording apparatus according to a fourth embodiment of the invention.

Although the mark is provided as a triangle-shaped mark S formed by painting in the third embodiment, the recording apparatus according to the invention is not limited to such shape and configuration. For example, as shown in FIG. 9, a line in the horizontal direction as a mark may be painted or printed on the exterior of the recording apparatus. Further, a mark can be provided on the exterior of the recording apparatus by assembling different colored members.

Fifth Embodiment

FIG. 10

Figure 10:
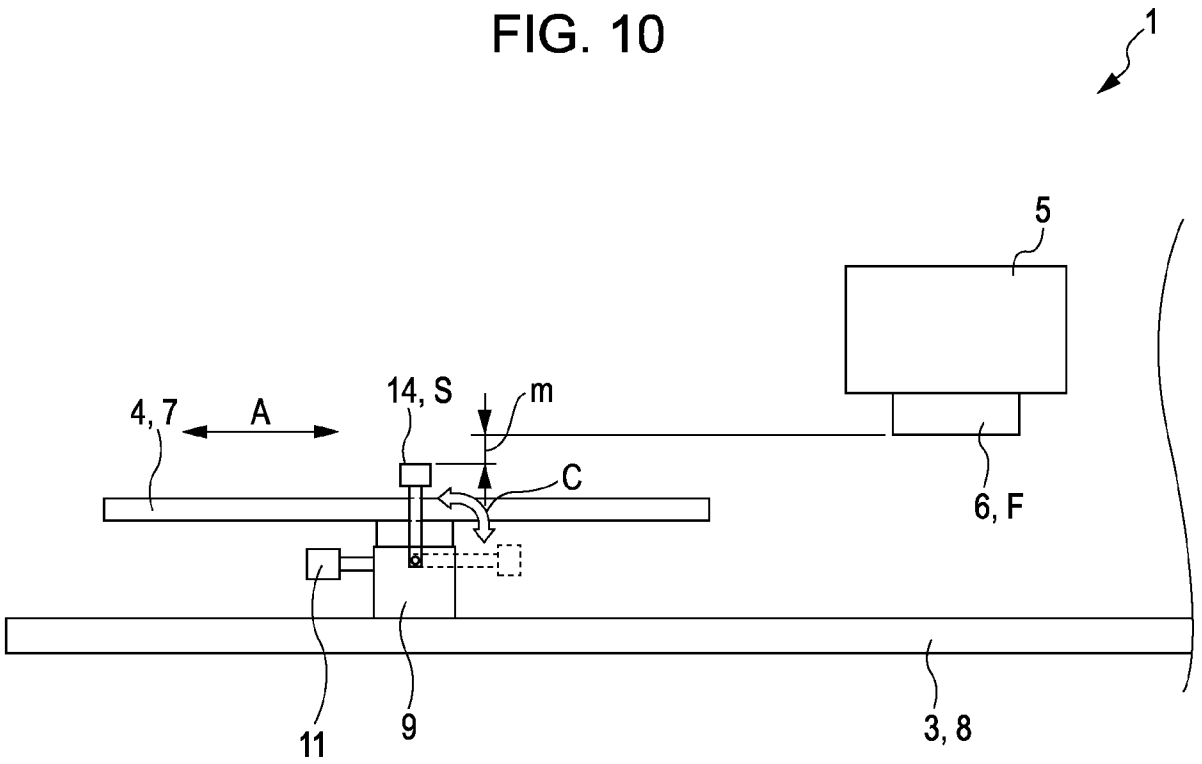
FIG. 10 is a schematic side view of a recording apparatus according to a fifth embodiment of the invention.

FIG. 10 is a schematic side view of a recording apparatus according to a fifth embodiment of the invention. The components similar to those of the first embodiment are denoted by the same reference numerals and further description thereof will be omitted.

In the recording apparatus 1 of this embodiment, an arm 14 is provided adjacent to the side face of the tray 4 with its proximal end being connected to the support mechanism 9 and its free end being rotatable in a direction C. The arm 14 has the mark S for adjustment of the height of the set surface 7 of the tray 4, and the distal end (free end) of the arm 14 also serves as the mark S. Since the arm 14 is rotatable in the direction C, the arm 14 can be turned up in the vertical direction only during adjustment of the height of the tray 4, and can be turned down in the horizontal direction to be retracted after adjustment of the height of the tray 4.

Although one arm 14 is disposed adjacent to the side face of the tray 4 in the transportation direction A of the target recording medium P in the recording apparatus 1 of this embodiment, the invention is not limited thereto. A movable arm may be disposed at any position, and a plurality of movable arms may be disposed at a plurality of positions. Further, although the distal end of the arm 14 also serves as the mark S for adjustment of the height of the set surface 7 of the tray 4 in the recording apparatus 1 of this embodiment, a configuration is also possible in which the mark is disposed on the arm 14. Moreover, although the arm 14 in the recording apparatus 1 of this embodiment is rotatable, the arm 14 may be slidable.

In the recording apparatus of the invention according to the first to the fifth embodiments, a distance between the ink ejection surface F which is the recording surface and the set surface 7 is adjusted according to the mark S disposed on the recording apparatus 1 at the setting operation position. Accordingly, it is possible to perform recording on the target recording medium having different thickness with a predetermined PG.

The entire disclosure of Japanese Patent Application No. 2012-117786, filed May 23, 2012 is expressly incorporated by reference herein.

What is claimed is:

1. A recording apparatus comprising:

a recording unit that performs recording;

a tray on which a target recording medium is set;

a movement mechanism that moves the tray relative to the recording unit between a setting operation position at which the target recording medium is set on the tray and a recording start position at which recording starts;

an adjustment section that is configured to adjust a distance between the recording unit and the tray in an adjusting direction that intersects the transportation direction; and a mark that corresponds to a position of the recording unit in the adjusting direction, wherein the tray and the mark are configured to move together in the transportation direction by the movement mechanism, the mark being associated with a plate member that is disposed between the tray and the recording unit, in the direction of movement of the movement mechanism, when the tray is at the setting operation.

2. The recording apparatus according to claim 1, wherein the mark is disposed between the tray and the recording unit when the tray is at the setting operation position.

3. The recording apparatus according to claim 1, wherein a top side of the plate member in the direction in which the distance is adjusted also serves as the mark.

4. The recording apparatus according to claim 1, wherein, when the tray is located at the setting operation position, a distance between the tray and the mark in the transportation direction is shorter than a distance between the tray and the recording unit in the transportation direction.

5. The recording apparatus according to claim 1, wherein a width of the plate member is larger than a width of the tray.

6. The recording apparatus according to claim 1, wherein the plate member is a mesh type plate member.

7. The recording apparatus according to claim 1, wherein a height of the recording unit is adjustable, and a height of the mark is configured to vary in response to an adjustment of the height of the recording unit.

8. The recording apparatus according to claim 1, wherein the mark is configured to retract after the adjustment by the adjustment section.

* * * * *